US008539653B2

(12) United States Patent
Gerhardt

(10) Patent No.: US 8,539,653 B2
(45) **Date of Patent: *Sep. 24, 2013**

(54) FOOTWEAR ACCESSORY

(75) Inventor: Audra Gerhardt, Los Angeles, CA (US)

(73) Assignee: China Cat, Inc., Pacific Palisades, CA (US)

( * ) Notice: Subject to any disclaimer, the term of this patent is extended or adjusted under 35 U.S.C. 154(b) by 502 days.

This patent is subject to a terminal disclaimer.

(21) Appl. No.: 12/614,312

(22) Filed: Nov. 6, 2009

(65) Prior Publication Data

US 2010/0050479 A1 Mar. 4, 2010

Related U.S. Application Data

(63) Continuation of application No. 11/286,701, filed on Nov. 22, 2005, now Pat. No. 7,614,126.

(51) Int. Cl.

| | |
|---|---|
| ***A43C 1/00*** | (2006.01) |
| ***A43C 11/24*** | (2006.01) |
| ***A43B 23/00*** | (2006.01) |

(52) U.S. Cl.
USPC ..... 24/712; 24/DIG. 16; 36/136; 36/58.5

(58) Field of Classification Search
USPC ..... 24/712, DIG. 16; 36/136, 58.5
See application file for complete search history.

(56) References Cited

U.S. PATENT DOCUMENTS

| | | | | |
|---|---|---|---|---|
| 1,196,281 | A | | 8/1916 | Quarters |
| 1,252,149 | A | | 1/1918 | Muse |
| 1,277,177 | A | | 8/1918 | Benedetti |
| 1,385,328 | A | | 7/1921 | Loudenslager |
| 1,483,192 | A | | 2/1924 | Langgons |
| 1,489,735 | A | | 4/1924 | Briggs |
| 1,655,715 | A | | 1/1928 | Sneeston |
| 1,794,959 | A | | 3/1931 | Howard |
| 2,233,544 | A | | 3/1941 | McKinley |
| 2,526,940 | A | | 10/1950 | Fello |
| 2,930,150 | A | | 3/1960 | Sandler |
| 3,000,119 | A | | 9/1961 | Altman |
| 3,197,793 | A | | 8/1965 | Walters |
| 3,314,090 | A | | 4/1967 | Azzarito |
| 3,570,147 | A | | 3/1971 | Chiu |
| 4,461,100 | A | * | 7/1984 | Minor et al. ..... 36/72 B |
| 4,735,010 | A | | 4/1988 | Grinarml |
| 4,854,056 | A | | 8/1989 | Levin |
| 5,038,499 | A | | 8/1991 | Martinez, Jr. |
| 7,614,126 | B2 | | 11/2009 | Gerhardt |
| 2006/0053661 | A1 | | 3/2006 | van Duyne |
| 2006/0107550 | A1 | | 5/2006 | Caminiti |
| 2006/0156586 | A1 | | 7/2006 | Brunelle-Wright |

* cited by examiner

*Primary Examiner* — Robert J Sandy
(74) *Attorney, Agent, or Firm* — Henricks, Slavin & Holmes LLP

(57) ABSTRACT

A strap for a shoe has a first resilient and flexible fabric element extending from a first end to a second end and a clear flexible element substantially fixed at respective ends of the clear flexible element to corresponding ends of the first fabric element. Methods of assembly and of use are described.

27 Claims, 6 Drawing Sheets

FOOTWEAR ACCESSORY

CROSS REFERENCE TO RELATED APPLICATIONS

This is a continuation of Ser. No. 11/286,701, filed Nov. 22, 2005, published as US2007/0113387, incorporated herein by reference, now U.S. Pat. No. 7,614,126.

BACKGROUND

Field

This relates to accessories for shoes, such as straps for mules.

SUMMARY

Accessories for footwear can include an upper or over portion and a lower or an under portion, where the over portion extends over the wearer's foot and the under portion extends under the shoe. The over portion and the under portion may be secured together at corresponding ends of each of the portions, forming a closed circuit, closed loop or endless strip. The over portion and under portion can take a number of configurations.

In one example of the footwear accessory, the accessory may include a strap, band or other continuous or endless element, hereinafter referred to as a strap. The strap includes an over portion for extending over the typically bare foot of the wearer. The over portion has ends secured to respective ends of the under portion. The under portion is preferably clear and may be a different material and/or different appearance from the over portion. In one example of the accessory, the accessory is not fixed to the shoe. The characteristics of the material of the strap help to hold the strap in place, for example a resiliently flexible material.

In another example of a footwear accessory, the accessory may include a strap having an upper or over portion and a lower or under portion where the under portion is formed from a clear flexible material. Preferably, the under portion is translucent to a casual observer so that the shoe is visible under the under portion, for example giving the appearance of no under-support.

In a further example of a footwear accessory, the accessory has a strap having a first portion formed from a resilient and flexible fabric material. The first portion is secured at respective ends to corresponding ends of a second portion that is clear. The second portion is also preferably flexible, for example to allow the second portion to conform to the underside of a shoe. In one example, the first portion has a width that is approximately the same as a width of the second portion. Additionally, the width is substantially less than the perimeter length of the accessory.

In an additional example, a footwear accessory is formed from first and second strap elements, each of which are formed from flexible materials. The second strap element is formed from a polyvinyl chloride material, and may be formed from a double polished clear PVC.

In another example, a shoe accessory can be assembled by providing a length of resilient and flexible fabric material and securing respective ends of the material to corresponding ends of a clear PVC element to form a continuous strap. The resilient and flexible fabric material and PVC element can have approximately the same width, and the length of the clear PVC element can be approximately the same as the perimeter of the underside of the shoe with which the accessory is to be worn.

In a further example, a shoe accessory can be worn by placing a clear portion of the accessory under the shoe and positioning an upper portion of the shoe accessory across a portion of the wearer's foot. The upper portion can be positioned over the foot as the foot is being placed into the shoe or after the foot is placed into the shoe. In another example, part of the upper portion can be positioned around an ankle of the wearer. In another example, the shoe accessory is secured into a figure-8 configuration, such as by tacking, and one loop with the clear portion placed in front of a heel of the shoe and behind the wearer's heel and the other loop around the wearer's ankle.

These and other examples are set forth more fully below in conjunction with drawings, a brief description of which follows.

DETAILED DESCRIPTION

Figure 1:
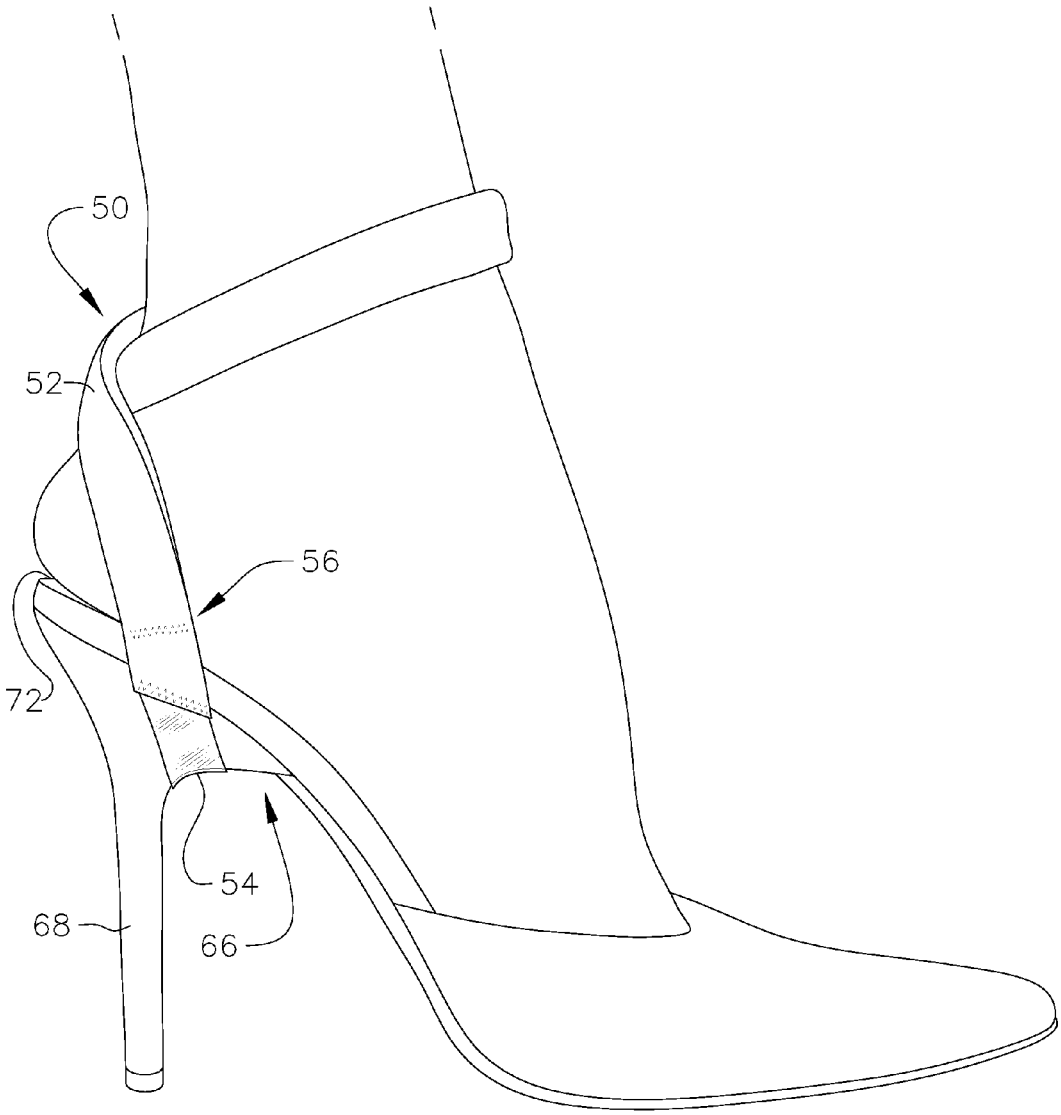
FIG. 1 is a side elevation view showing a wearer's foot in a strap less shoe, in this example a mule, and a removable accessory strap.

This specification taken in conjunction with the drawings sets forth examples of apparatus and methods incorporating one or more aspects of the present inventions in such a manner that any person skilled in the art can make and use the inventions. The examples provide the best modes contemplated for carrying out the inventions, although it should be understood that various modifications can be accomplished within the parameters of the present inventions.

Examples of shoe accessories and of methods of making and using the shoe accessories are described. Depending on what feature or features are incorporated in a given structure or a given method, benefits can be achieved in the structure or the method. These and other benefits will become more apparent with consideration of the description of the examples herein. However, it should be understood that not all of the benefits or features discussed with respect to a particular example must be incorporated into a shoe accessory or method in order to achieve one or more benefits contemplated by these examples. Additionally, it should be understood that features of the examples can be incorporated into a shoe accessory or method to achieve some measure of a given benefit even though the benefit may not be optimal compared to other possible configurations. For example, one or more benefits may not be optimized for a given configuration in order to achieve cost reductions, efficiencies or for other reasons known to the person settling on a particular product configuration or method.

Examples of a number of shoe accessories and of methods of making and using the shoe accessories are described herein, and some have particular benefits in being used together. However, even though these apparatus and methods are considered together at this point, there is no requirement that they be combined, used together, or that one component or method be used with any other component or method, or combination. Additionally, it will be understood that a given component or method could be combined with other structures or methods not expressly discussed herein while still achieving desirable results.

One example of a shoe accessory 50 (FIGS. 1 and 4) includes an upper portion 52 and a lower portion 54. The upper portion includes a first end portion 56 and a second end portion 58 (FIG. 4) with a relatively continuous (and uniformly-sized) portion in between. The upper portion may take the form of a strap, band, strip or other linear element whose length is preferably substantially greater than the width. The upper portion will hereafter be termed a strap, but it is understood that the upper portion can have other configurations besides the specific examples provided herein.

Figure 2:
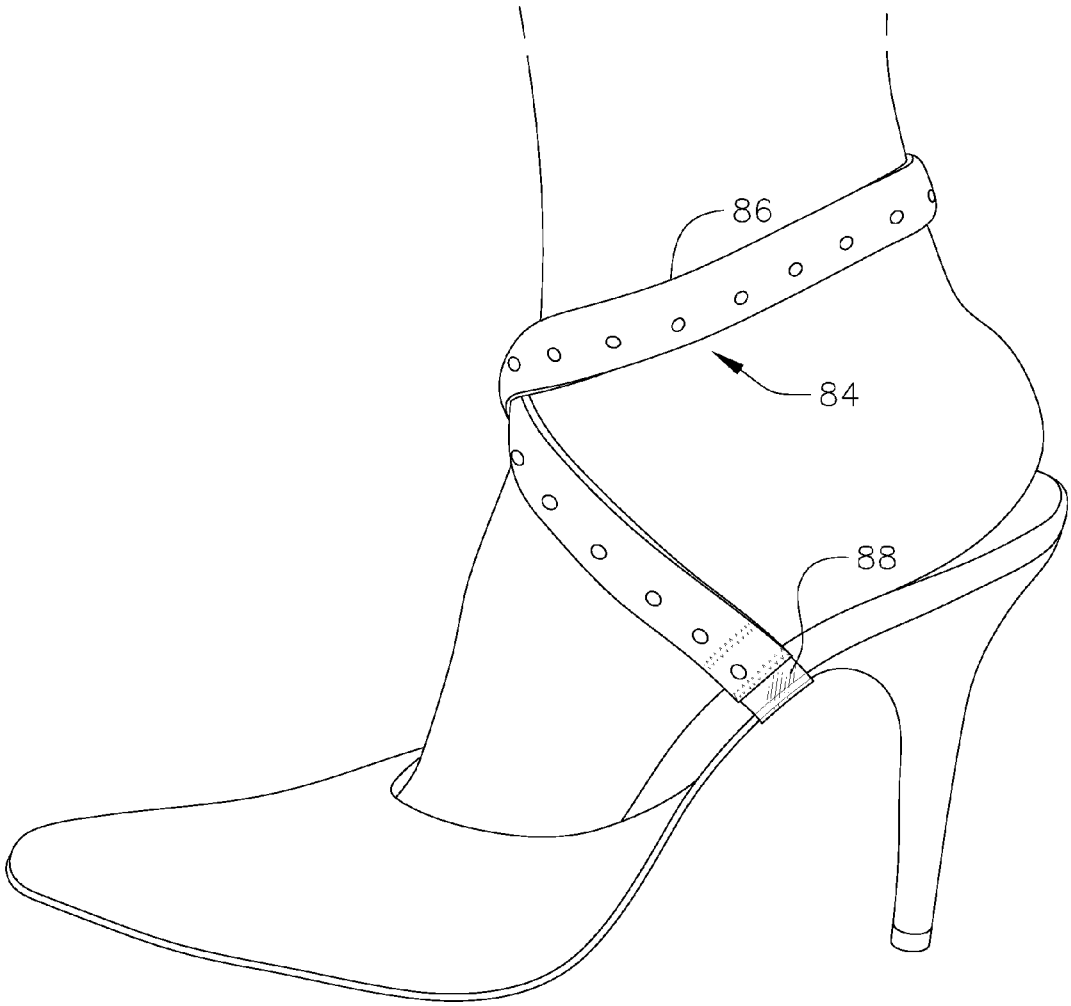
FIG. 2 is a side elevation view showing a wearer's foot in a mule with another example of an accessory strap.
Figure 9:
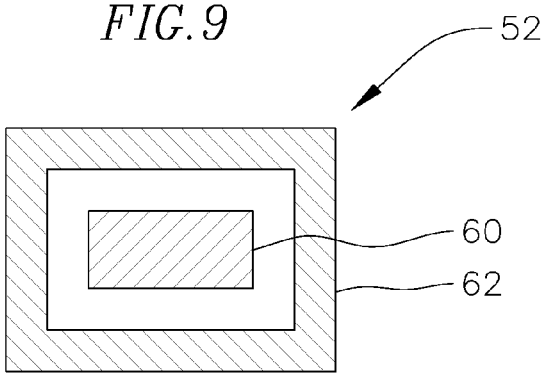
FIG. 9 is a schematic cross-sectional view of a decorative portion of the accessory strap of FIG. 1.

The upper strap 52 in the examples described herein are formed from an internal band of elastic 60 to which is sewn or otherwise secured a Lycra fabric or other resilient and flexible fabric 62 (FIG. 9). The fabric 62 preferably encircles or otherwise surrounds the length of the elastic band 60 (though not necessarily the ends), and is approximately the same length as the elastic band 60 in their respective relaxed states. The fabric 62 may be a decorative fabric, a fabric selected for comfort or other material as desired. In another example, the upper strap 52 can be a clear material, such as a clear plastic sufficiently flexible and preferably resilient to fit comfortably around the ankle or the corresponding portion of the foot (such as in the examples of FIGS. 2 and 3). An outer layer or cover can be omitted if desired.

A lower portion 54 is a strap, band, strip or other linear element. The lower portion will be hereinafter referred to as the strap 54. The lower strap 54 is a clear strap so that the strap appears translucent or transparent to a casual observer. As a result, the lower strap 54 appears invisible, and the features of the shoe under the strap 54 are visible through the strap. Therefore, the appearance of the shoe accessory in this example is that there is little if anything keeping the accessory in place from under the shoe. However, the characteristics of the upper portion being flexible and resilient help to hold the accessory in place relative to the shoe and wearer's foot, and the lower strap 54 holds the strap 50 in place from below the shoe. In the present example, the lower strap 54 follows the contour under the arch 66 of the shoe, immediately forward of the heel 68. The remainder of the lower loop 70 of the strap 50 extends upward from the sole 72 of the shoe and behind the wearer's ankle where the upper strap chris-crosses at the tacking point 64. The upper loop 74 encircles the wearer's ankle. In this example, the accessory follows a path around part of the shoe, part of the wearer's foot and around the wearer's ankle, approximately conforming to be adjacent surfaces. The elastic (or other resilient material) in the elastic band 60 and any resilient characteristic in the fabric 62 helps to position the accessory. Attachment to the shoe is not necessary. The length of the strap 54 is preferably substantially greater than the width, and has a width that is approximately the same as the width of the upper portion.

Figures 4, 5:
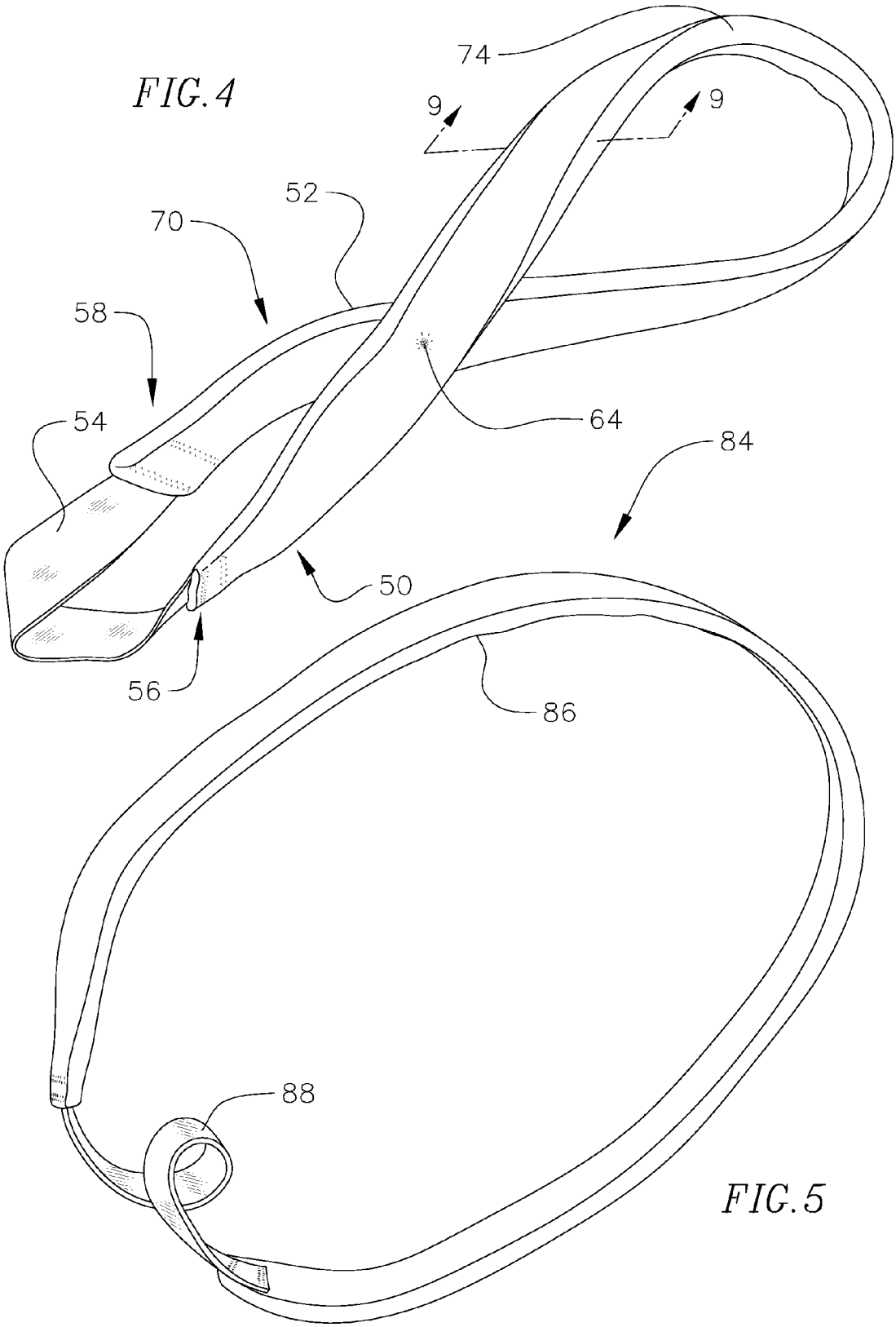
FIG. 4 is a plan view of the accessory strap shown in FIG. 1.
FIG. 5 is a plan view of the accessory strap shown in FIG. 2.
Figure 8:
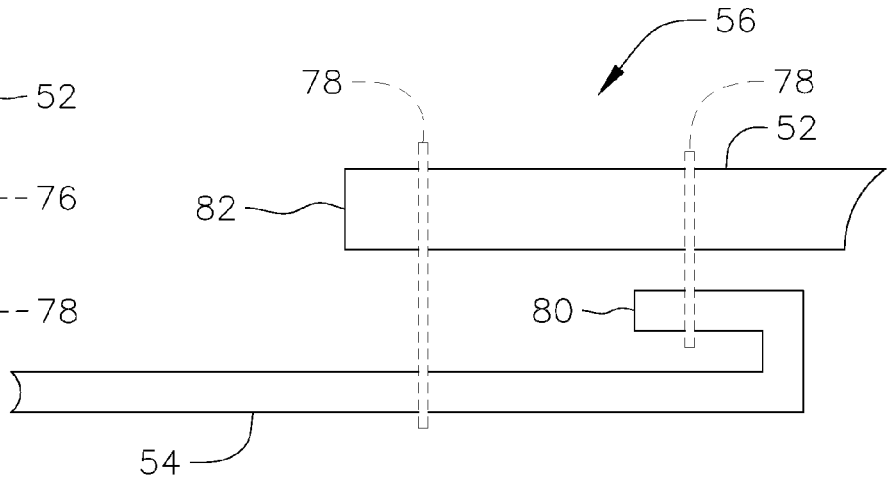
FIG. 8 is a schematic and side elevation view of a securement or joinder area between two portions of an accessory strap.

In the present example of the accessory 50, the accessory is secured into an endless figure-8 configuration (FIG. 4). In the present example, the figure-8 configuration is obtained through tacking or other securement 64, applied generally through the centers of the two sides of strip overlapping each other. The tacking can be applied either before or after the lower strap 54 is secured. No buckles or other releasable closures are used in these examples.

Figure 7:
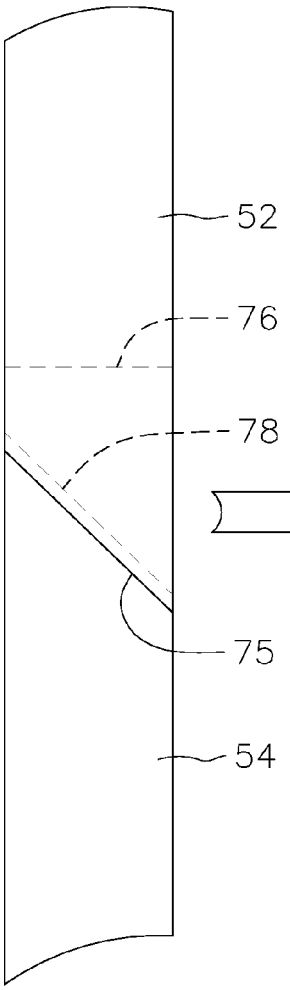
FIG. 7 is a schematic and plan view of a portion of the accessory shown in FIG. 4 showing the cut of a decorative portion of the accessory and stitching pattern.

In the configuration of the accessory 50 shown in FIGS. 1 and 4, the first and second ends 56 and 58 of the upper strap 52 are cut at an angle as represented at 74 in FIG. 7. The angle is selected so as to approximate as closely as possible the angle of the sole 72 relative to the strap 50 where the accessory extends adjacent the sole. The lower strap 54 has a square end so that the angle 74 is also at an angle to the square end of the lower strap 54.

Each of the first and second ends of the upper strap 52 are secured to corresponding ends of the lower strap 54 through stitching or other means. As represented in the schematic of FIG. 7, a first row of stitching 76 extends substantially transverse to the length of the upper and lower straps 52 and 54, preferably perpendicular to the length of the straps. The first row of stitching 76 preferably extends transverse to the lower strap 54 to reduce the possibility of tearing of the material of the lower strap. The free end of the upper strap 52 is also stitched to the lower strap 54 through stitching 78. The stitching 78 preferably extends parallel to the cut end of the upper strap 52.

During assembly, one end 56 of the upper strap 52 is secured to the corresponding end of the lower strap 54 through the stitching 78 (FIG. 8 schematically showing end portions of the upper and lower straps). The stitching 78 is back stitched while the adjacent ends are directed in the same direction. The back stitching 78 is positioned about 1/16 or 1/32 of an inch from the free end 80 of the lower strap. The lower strap is then folded or bent back and the stitching 78 front stitched to secure the free end 82 of the upper strap to the lower strap 54. The left and right sides of the strap (relative to the wearer's foot) will be substantial mirror images of each other. During assembly, one or the other of the upper and lower straps is twisted 360 degrees about a longitudinal axis before the corresponding ends are secured together. This permits the back crossing while still having each portion of the strap lying flat.

In a further example of a shoe accessory, a front crossing strap 84 (FIGS. 2 and 5) is configured and assembled substantially similar to the back-crossing strap 50 described with respect to FIGS. 1 and 4 while omitting the tacking 64 (FIG. 4). The front crossing strap 84 includes an upper strap 86, which may be but need not be substantially identical to the upper strap 52, and a lower strap 88 preferably substantially identical to the lower strap 54. The strap 84 is formed as a continuous loop with one or the other of the upper and lower straps twisted 360 degrees before the corresponding ends are secured together. Therefore, the front crossing strap during use will lie flat against the adjacent surfaces of the shoe, the wearer's foot or the ankle. The ends are preferably secured together first by back stitching and then front stitching, as described with respect FIG. 8, and the lower strap preferably has square ends. The upper strap ends are preferably cut at an angle approximating the angle of the sole of the shoe relative to the strap where the strap 84 crosses the sole. The construction and the configuration of the components of the upper and lower straps in this example are the same as those described with respect to the strap 50. While the Lycra layer of material can be omitted, use of different patterns, configurations and decorative features in or as part of the Lycra material around the elastic strip 60 allows easy manufacture of a large number of straps having different appearance. Because the straps are not fixed to the shoe and are easily removable, straps of different styles, colors and other decorative features can be easily substituted for one another. Additionally, with the front crossing configuration, one size of strap can easily fit many different wearers.

Figure 3:
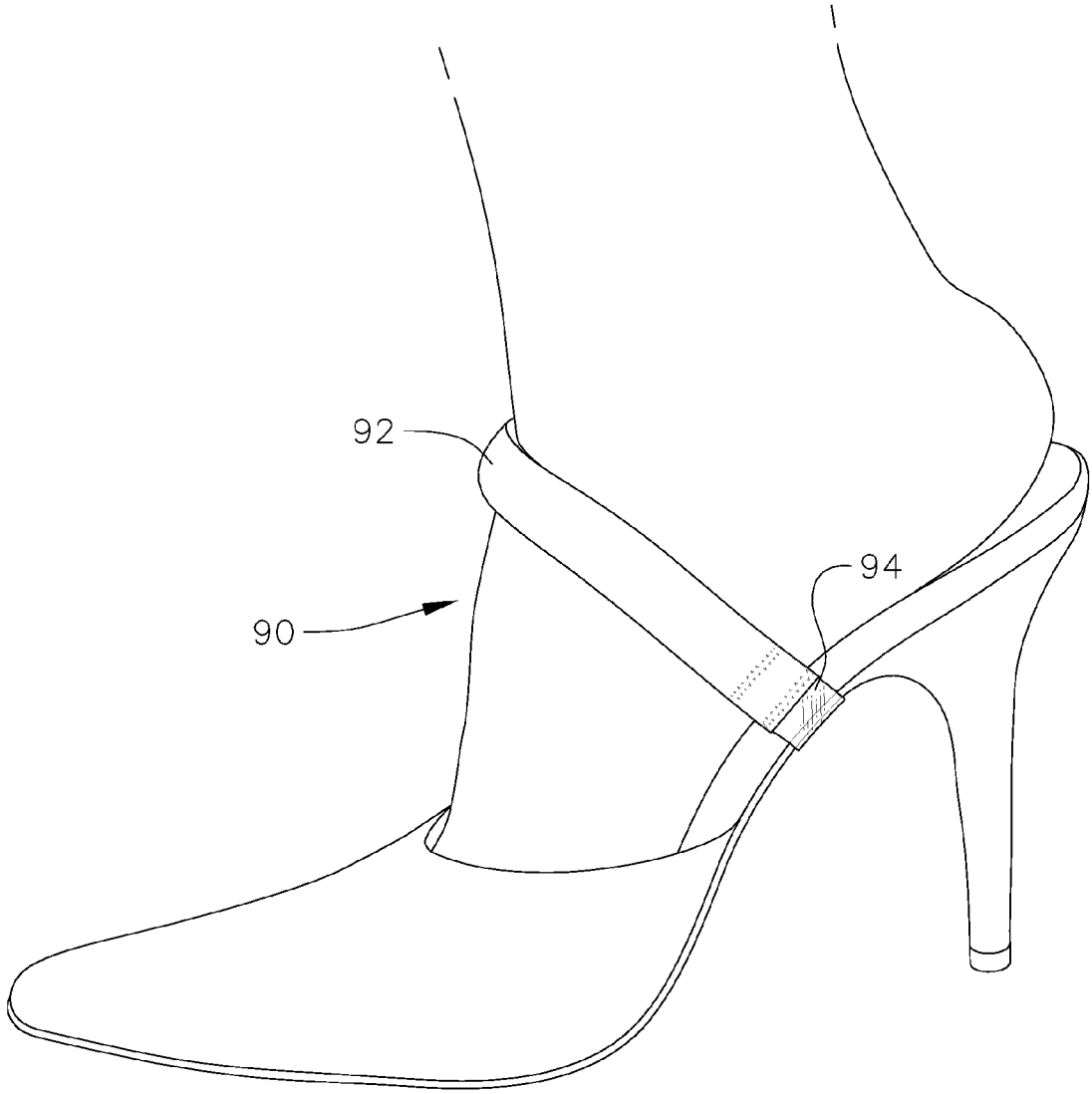
FIG. 3 is a side elevation view showing a wearer's foot in a mule with a further example of an accessory strap.
Figure 6:
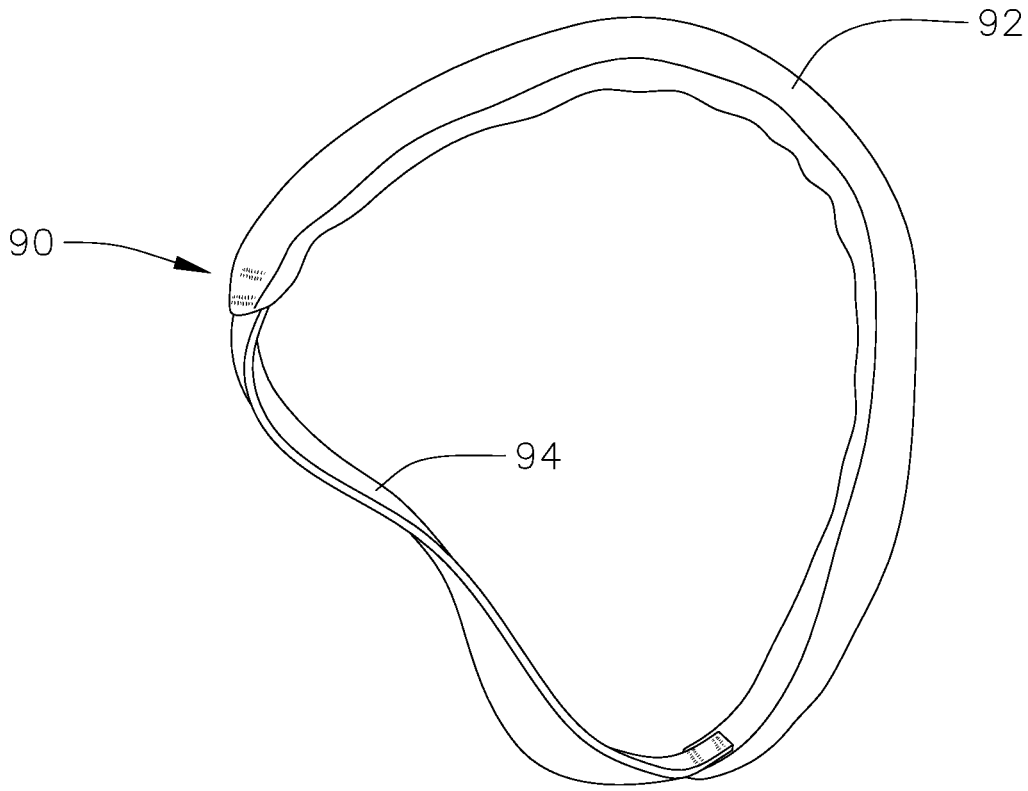
FIG. 6 is a plan view of the accessory strap shown in FIG. 3.

In another example of a shoe accessory, a foot strap 90 (FIGS. 3 and 6) includes an upper strap 92 and a lower strap 94. The foot strap 90 is configured and assembled substantially similar to the back-crossing strap 50 and the front crossing strap 84 except that the strap 90 is a continuous loop, without twist, without any tacking, and the ends of the upper strap 92 are cut substantially square or transverse to the length of the strap. The upper strap includes an elastic portion and an outer fabric covering, and the lower portion 94 is preferably formed from double polished clear polyvinyl chloride. The corresponding ends are preferably secured together through a back stitch and then a front stitch. As shown in FIG. 3, the lower portion conforms to the underside of the arch of the shoe, forward of the heel and the upper portion extends over the wearer's arch.

In each of the examples, the elastic strip is preferably half-inch flat knit elastic such as style No. 2222 from State Narrow Fabrics. The Lycra or other covering, if present, encircles the elastic, and they are assembled in the desired lengths using a 3 threaded over lock stitching, such as may be done with a Union Special Mark IV 39-500 machine. The upper straps may be configured in a manner similar to that used with bathing suit straps or the like. The length of the upper strap in the front and back crossover straps may range from 12 to 15 inches, and possibly more or less depending on the wearer, any decorative features and the configuration of any Lycra or other covering. For example, a covering with some decorations, such as rhinestones, metal or other components may suggest longer straps. A number of applications will have the upper straps 11 or 12 to 14 inches long. The strap of FIG. 3 is about eight inches long.

Also in each of the examples, the lower strap is a ½ inch×4 inch, 16 gauge, double polished clear PVC such as that offered by PVC Tech Corp. under their part number DPCLR016-54-L-CM. Other gauges such as 18 gauge or 20 gauge can be used, but 16 gauge is preferred. The lower strap is flexible and slightly resilient, though not as resilient as elastic, and the length may range from two inches to five inches, more or less. The lower strap is attached to the upper strap through a single needle lock stitch machine, approximately 12-14 stitches per inch. The needles are preferably 36 needles but may be 40 needle equipment, but the range may be between 32 and 40, more or less. The thread used is preferably a Tek-40 poly-cotton thread.

Having thus described several exemplary implementations, it will be apparent that various alterations and modifications can be made without departing from the concepts discussed herein. Such alterations and modifications, though not expressly described above, are nonetheless intended and implied to be within the spirit and scope of the inventions. Accordingly, the foregoing description is intended to be illustrative only.

What is claimed is:

1. A shoe accessory comprising a strap sized to extend under a portion of a person's shoe and about at least one of a person's foot and ankle, wherein the strap has a length and a width and wherein the length is greater than the width, wherein the strap includes a first resilient and flexible portion extending from a first end portion to a second end portion and wherein the strap further includes a second at least translucent portion extending from the first end portion to the second end portion, and wherein the second at least translucent portion is sized sufficiently long so that the second at least translucent portion can extend completely under a portion of a person's shoe.

2. The accessory of claim 1 wherein the second at least translucent portion is transparent.

3. The accessory of claim 1 wherein the second at least translucent portion is clear.

4. The accessory of claim 1 wherein the first resilient and flexible portion includes a cover extending over at least a portion of the first resilient and flexible portion.

5. The accessory of claim 4 wherein the cover extends circumferentially about the first resilient and flexible portion.

6. The accessory of claim 4 wherein the cover is formed from a synthetic fabric.

7. The accessory of claim 6 wherein the cover is formed from a spandex.

8. The accessory of claim 1 wherein the first resilient and flexible portion extends in a first direction to the first end portion and wherein the second at least translucent portion includes a securement area extending at an angle to the first direction other than perpendicular.

9. The accessory of claim 8 wherein the securement area includes a folded portion.

10. The accessory of claim 9 wherein the securement area includes an end portion secured to the first resilient and flexible portion and also includes a second securement of the securement area to the first resilient and flexible portion spaced from the end portion.

11. The accessory of claim 10 wherein the end portion is secured to the first resilient and flexible portion through stitching and the second securement is stitching.

12. The shoe accessory of claim 1 wherein the first resilient and flexible portion is clear.

13. The shoe accessory of claim 1 wherein the first resilient and flexible portion is configured to be a substantially continuous strap element.

14. A shoe and strap combination comprising a shoe having a heel portion and a toe portion and a sole portion between the heel and toe portions and a strap having a first strap portion extending above the sole portion between first and second end portions of the first strap portion and a second strap portion extending below the sole portion and wherein the second strap portion extends between the first and second end portions of the first strap portion, and wherein the second strap portion is configured so that the sole portion of the shoe is visible through the second strap portion.

15. The combination of claim 14 wherein the first strap portion includes a resilient and flexible fabric material.

16. The combination of claim 14 wherein the second strap portion is transparent.

17. The combination of claim 14 wherein the second strap portion is formed from clear polyvinyl chloride.

18. The combination of claim 14 wherein the first and second strap portions are secured to each other through a front stitch and a back stitch.

19. The combination of claim 14 wherein the first strap portion is clear.

20. The combination of claim 14 wherein the first strap portion is configured to be a substantially continuous strap element.

21. A shoe accessory comprising a strap sized to extend under a portion of a person's shoe and about at least one of a person's foot and ankle, wherein the strap has a length and a width and wherein the length is greater than the width, wherein the strap includes a first resilient and flexible portion extending from a first end portion to a second end portion and wherein the strap further includes at least a translucent portion sized sufficiently long so as to extend completely under a portion of a person's shoe.

22. The shoe accessory of claim 21 wherein the first resilient and flexible portion is clear.

23. The shoe accessory of claim 21 wherein the first end portion and the second end portion are coupled together.

24. The shoe accessory of claim 21 wherein the first resilient and flexible portion is configured and is sufficiently long to extend around a wearer's ankle.

25. The shoe accessory of claim 21 wherein the first resilient and flexible portion is configured and is sufficiently long to extend over a wearer's foot.

26. The shoe accessory of claim 21 wherein the first resilient and flexible portion has a different appearance from that of the translucent portion.

27. The shoe accessory of claim 21 wherein the strap is configured to be a substantially continuous strap element.

* * * * *